US011555290B2

(12) United States Patent
Kim

(10) Patent No.: US 11,555,290 B2
(45) Date of Patent: Jan. 17, 2023

(54) APPARATUS FOR FIXING UPPER SWING STRUCTURE OF CONSTRUCTION MACHINE

(71) Applicant: Volvo Construction Equipment AB, Eskilstuna (SE)

(72) Inventor: Jungsu Kim, Gyeongsangnam-do (KR)

(73) Assignee: Volvo Construction Equipment AB, Eskistuna (SE)

( * ) Notice: Subject to any disclaimer, the term of this patent is extended or adjusted under 35 U.S.C. 154(b) by 933 days.

(21) Appl. No.: 16/345,341

(22) PCT Filed: Oct. 27, 2016

(86) PCT No.: PCT/KR2016/012195
§ 371 (c)(1),
(2) Date: Oct. 1, 2019

(87) PCT Pub. No.: WO2018/079879
PCT Pub. Date: May 3, 2018

(65) Prior Publication Data

US 2020/0018042 A1 Jan. 16, 2020

(51) Int. Cl.
*E02F 9/12* (2006.01)
*E02F 3/32* (2006.01)

(52) U.S. Cl.
CPC ..... *E02F 9/125* (2013.01); *E02F 3/32* (2013.01)

(58) Field of Classification Search
CPC .. B66C 23/84; E02F 9/126; E02F 9/12; E02F 9/123; E02F 9/20; E02F 9/202;
(Continued)

(56) References Cited

U.S. PATENT DOCUMENTS 1,272,110 A * 7/1918 Robinson ..... E02F 9/062 212/302
2,313,084 A * 3/1943 Manly ..... B66C 23/84 104/46
2,472,726 A * 6/1949 Russell ..... E02F 9/121 414/689
(Continued)

FOREIGN PATENT DOCUMENTS

KR 10-02001-0071547 A 7/2001
KR 10-2009-0070642 A 7/2009
(Continued)

OTHER PUBLICATIONS

International Search Report and Written Opinion of the International Searching Authority, PCT/KR2016/012195, dated Jul. 14, 2017 (including English translation of the International Search Report), 10 pages.

*Primary Examiner* — Edwin J Toledo-Duran
(74) *Attorney, Agent, or Firm* — Sage Patent Group

(57) ABSTRACT

An apparatus for retaining an upper pivoting body of a construction machine having a lower traveling body includes a protrusion on a lower surface of the upper pivoting body, a socket portion on an upper side of the lower traveling body that couples with the protrusion, an elastic member on a lower side of the socket portion that elastically supports the socket portion, a first tapered member on a lower side of the elastic member to support the elastic member, a lower surface of the first tapered member having a sloping surface, and a second tapered member on a lower side of the first tapered member. The upper surface of the second tapered member has a sloping surface that makes sliding contact with the first tapered member. The second tapered member lifts the socket portion, through a horizontal movement, to be coupled with the protrusion or lowers the socket portion to be separated from the protrusion.

7 Claims, 2 Drawing Sheets

(58) Field of Classification Search
CPC ..... E02F 9/2095; E02F 9/125; E02F 9/0858; E02F 9/24; E02F 3/32; F16J 15/32; B60L 2200/40; F16H 1/04; B60Y 2200/412
See application file for complete search history.

(56) References Cited

U.S. PATENT DOCUMENTS 2,838,183 A * 6/1958 McIntyre, Sr. ..... B66C 23/84 212/247
2,928,381 A * 3/1960 MacDonald ..... E02F 3/764 91/186
3,184,867 A * 5/1965 Symmank ..... E02F 9/028 180/9.54
3,369,672 A * 2/1968 Lorence ..... B62D 55/062 475/83
4,102,461 A * 7/1978 Soyland ..... B60K 5/00 212/253
4,906,113 A * 3/1990 Sague ..... F16C 33/3706 384/618
4,943,182 A * 7/1990 Hoblingre ..... F16D 1/108 403/328
5,074,370 A * 12/1991 Lindstrot ..... E02F 9/24 180/41
6,164,829 A * 12/2000 Wenzel ..... F16C 11/0638 403/135
2002/0020685 A1* 2/2002 Weckbecker ..... F16C 19/50 212/181
2003/0085562 A1* 5/2003 Sparling ..... B60G 5/00 280/789
2004/0244521 A1* 12/2004 Russ ..... B66C 23/84 74/425
2005/0253339 A1* 11/2005 Hoshi ..... B66C 23/84 277/549
2007/0152438 A1* 7/2007 Lacher ..... B62D 21/186 280/781
2013/0089400 A1* 4/2013 Uzawa ..... E02F 9/202 414/744.1
2013/0197766 A1* 8/2013 Kurikuma ..... E02F 9/2246 701/50
2014/0294486 A1* 10/2014 Staade ..... B62D 7/16 403/113
2015/0226288 A1* 8/2015 Shizu ..... F16H 57/0486 475/333
2016/0010309 A1* 1/2016 Bienfang ..... E02F 9/12 29/893.2
2016/0010694 A1* 1/2016 Bienfang ..... E02F 9/123 384/593

FOREIGN PATENT DOCUMENTS

KR 10-2010-0091447 A 8/2010
KR 10-2013-0033572 A 4/2013

* cited by examiner

APPARATUS FOR FIXING UPPER SWING STRUCTURE OF CONSTRUCTION MACHINE

CROSS REFERENCE TO RELATED APPLICATIONS

This application is a 35 U.S.C. § 371 national stage application of PCT International Application No. PCT/KR2016/012195 filed on Oct. 27, 2016, the disclosure and content of which is incorporated by reference herein in its entirety.

TECHNICAL FIELD

The present invention relates to an apparatus for fixing an upper swing structure of a construction machine and, more specifically, to an apparatus for fixing an upper swing structure of a construction machine capable of conveniently fixing an upper swing structure of a construction machine such as a wheel-type excavator on a lower traveling structure and conveniently switching the upper swing structure to a rotatable condition.

BACKGROUND ART

In the case of a construction machine, for example, a wheel-type excavator, an upper swing structure is physically fixed on a lower traveling structure before traveling so as to prevent the upper swing structure from rotating during the traveling.

To this end, in the related art, the upper swing structure is formed with a hole for pin insertion. Also, the lower traveling structure is equipped with a bracket to which the pin inserted in the hole formed in the upper swing structure can be fixed. Before the wheel-type excavator travels, a driver rotates the upper swing structure to align the hole and the bracket and inserts the pin into the hole. Then, the driver fixes the pin to the bracket.

Also, for an excavating work, the upper swing structure should be at a rotatable condition. Therefore, before the wheel-type excavator works, the upper swing structure should be switched to the rotatable condition. In the related art, the driver directly removes the pin fixed to the bracket.

However, since a considerable force is required for the series of operations, and the traveling and work are frequently repeated due to characteristics of the wheel-type excavator, there are considerable inconveniences and difficulties for the driver to repeat the operations each time.

SUMMARY OF INVENTION

Technical Problem

The present invention has been made in view of the above situations, and an object thereof is to provide an apparatus for fixing an upper swing structure of a construction machine capable of conveniently fixing an upper swing structure of a construction machine such as a wheel-type excavator on a lower traveling structure and conveniently switching the upper swing structure to a rotatable condition.

Solution to Problem

In order to achieve the above object, according to the present invention, there is provided an apparatus for fixing an upper swing structure of a construction machine, the apparatus being provided to the construction machine including a lower traveling structure, an upper swing structure mounted to be swingable on the lower traveling structure and a working device mounted to the upper swing structure, the apparatus being configured to fix the upper swing structure on the lower traveling structure before traveling, the apparatus including a protrusion formed on a lower surface of the upper swing structure and having a lower side of an outer peripheral surface configured as an inclined surface; a socket part formed on an upper side of the lower traveling structure and configured to be coupled with the protrusion in a female/male engaging manner; an elastic member arranged on a lower side of the socket part and configured to elastically support the socket part; a first tapered member arranged on a lower side of the elastic member, configured to support the elastic member, and having a lower surface configured as an inclined surface, and a second tapered member arranged on a lower side of the first tapered member, having an upper surface configured as an inclined surface so as to make sliding contact with the first tapered member, and configured to move up the socket part to a position at which the socket part can be coupled with the protrusion or to move down the socket part so that the socket part is to be decoupled from the protrusion, through horizontal movement.

The inclined surface of the first tapered member and the inclined surface of the second tapered member may have the same inclination angle, and an upper surface of the first tapered member and a lower surface of the second tapered member may be horizontal surfaces.

The apparatus may further include a body part formed on an upper surface of the lower traveling structure, configured to accommodate therein the socket part, the elastic member and the first tapered member, and having an upper end opened so as to enable the socket part to move up and down and a lower end of which both sides in a horizontal direction are opened so that the second tapered member can be inserted therein.

The first tapered member may be restrained from moving in the horizontal direction by the body part.

Also, when the second tapered member moves toward one side in the horizontal direction, the first tapered member may move up along the inclined surface of the second tapered member, and when the second tapered member moves toward the other side in the horizontal direction, the first tapered member may move down along the inclined surface of the second tapered member.

The socket part may include a socket body having an upper side of an outer peripheral surface configured as an inclined surface so as to make sliding contact with the inclined surface of the protrusion, and a groove formed inwardly from an upper end of the socket body so that the protrusion can be inserted therein.

The inclined surface of the protrusion and the inclined surface of the socket body may have the same inclination angle.

Advantageous Effects of Invention

According to the present invention, it is possible to conveniently fix the upper swing structure on the lower traveling structure before a wheel-type excavator travels, and to conveniently switch the upper swing structure fixed to the lower traveling structure to a rotatable condition before the wheel-type excavator works.

That is, according to the present invention, it is possible to conveniently change the upper swing structure to a rotation preventing mode or a rotation mode in accordance with an operating method of the wheel-type excavator, so that it is possible to increase driver's convenience.

DESCRIPTION OF EMBODIMENTS

Hereinafter, an apparatus for fixing an upper swing structure of a construction machine in accordance with an embodiment of the present invention will be described in detail with reference to the accompanying drawings.

When describing the present invention, the specific descriptions of the related well-known functions or configurations will be omitted if it is considered that the descriptions make the gist of the present invention unclear.

Figure 1:
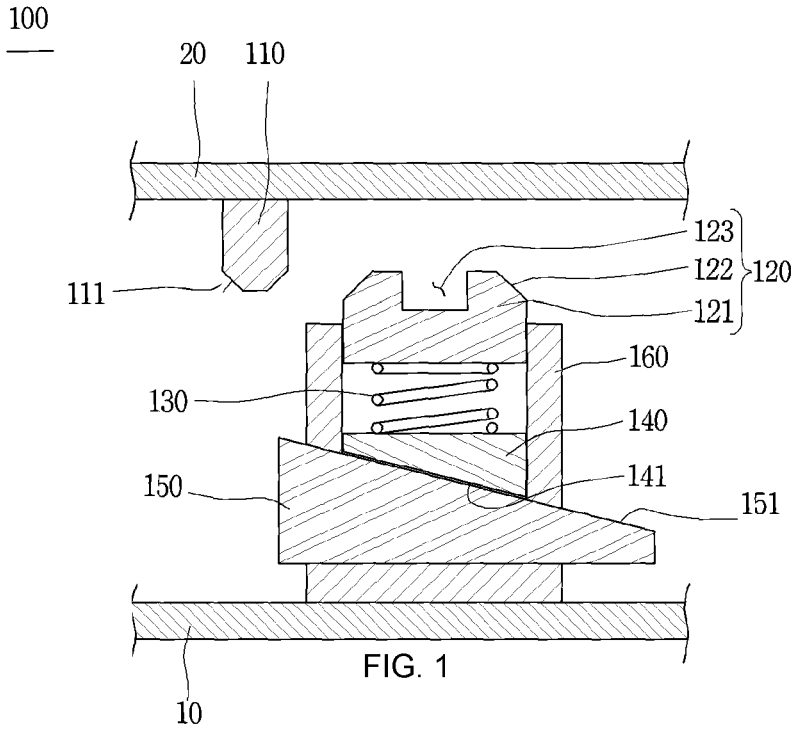
FIG. 1 is a schematic sectional view depicting an apparatus for fixing an upper swing structure in accordance with an embodiment of the present invention to be mounted on a wheel-type excavator.
Figure 2:
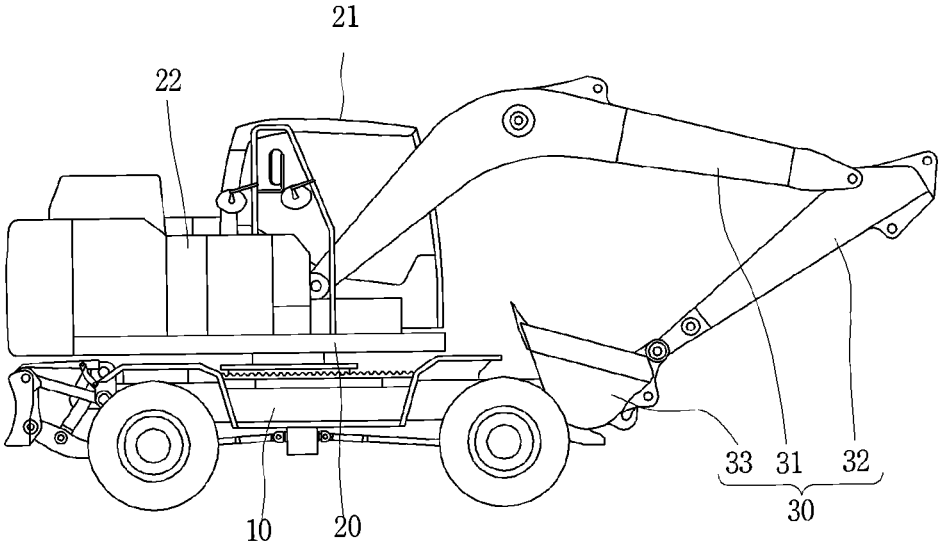
FIG. 2 is a side view depicting a general wheel-type excavator.

As shown in FIGS. 1 and 2, an apparatus 100 for fixing an upper swing structure of a construction machine in accordance with an embodiment of the present invention is an apparatus that is equipped to a construction machine, for example, a wheel-type excavator, and is configured to fix, before traveling, an upper swing structure 20 on a lower traveling structure 10 so as prevent the upper swing structure 10 of the wheel-type excavator from rotating during the traveling.

Here, the wheel-type excavator includes the lower traveling structure 10, the upper swing structure 20 and a working device 30. The upper swing structure 20 is swingably mounted on the lower traveling structure 10, and is configured to rotate to a desired position in accordance with a driver's operation. The upper swing structure 20 is equipped with an operator's cab 21 and an engine room 22. Also, the working device 30 is mounted to the upper swing structure 20. The working device 30 includes a boom 31, an arm 32 and a bucket 33. The boom 31, the arm 32 and the bucket 33 are respectively configured to be actuated by a corresponding cylinder that is to be driven by a hydraulic circuit configured to control a flow rate and flow of operating oil to be discharged from a hydraulic pump. The hydraulic circuit is configured to be operated by a pilot signal pressure that is to be applied by a driver's operation.

The apparatus 100 for fixing an upper swing structure in accordance with the embodiment of the present invention, which is equipped to the wheel-type excavator, is configured to be switched between a lock mode and a lock releasing mode. When the apparatus 100 for fixing an upper swing structure is in the lock mode, the upper swing structure 20 is in a rotation preventing mode, and when the apparatus 100 for fixing an upper swing structure is in the lock releasing mode, the upper swing structure 20 is in a rotation mode. When the wheel-type excavator is to be operated in a traveling mode, the upper swing structure 20 is required to be switched to the rotation preventing mode before the traveling, and when the wheel-type excavator is to be operated in a working mode, the upper swing structure 20 is required to be switched to the rotation mode before work.

In order to switch the upper swing structure 20 to the rotation mode or the rotation preventing mode, the apparatus 100 for fixing an upper swing structure in accordance with the embodiment of the present invention includes a protrusion 110, a socket part 120, an elastic member 130, a first tapered member 140, a second tapered member 150 and a body part 160.

The protrusion 110 is formed on the upper swing structure 20 and configures one part of the apparatus 100 for fixing an upper swing structure. The protrusion 110 is formed on a lower surface of the upper swing structure 20. The protrusion 110 is formed to protrude downward from the lower surface of the upper swing structure 20. The protrusion 110 is configured to move toward the socket part 120 and to be coupled with the socket part 120 in a female/male engaging manner by rotation of the upper swing structure 20.

When the protrusion 110 is coupled with the socket part 120, the apparatus 100 for fixing an upper swing structure is switched to the lock mode, so that the upper swing structure 20 is prevented from rotating. Also, when the protrusion 110 is decoupled from the socket part 120, the apparatus 100 for fixing an upper swing structure is switched to the lock releasing mode, so that the upper swing structure 20 is at a rotatable condition.

In the meantime, a lower side of an outer peripheral surface of the protrusion 110 is configured as an inclined surface 111. The inclined surface 111 of the protrusion 110 is configured to make sliding contact with an inclined surface 122 of the socket part 120. The protrusion 110 and the socket part 120 are coupled with each other through interaction of the inclined surfaces 111, 122 configured to make sliding contact with each other, which will be described later in more detail.

The socket part 120 is formed on an upper side of the lower traveling structure 10. The socket part 120 configures the other part of the apparatus 100 for fixing an upper swing structure together with the elastic member 130, the first tapered member 140, the second tapered member 150 and the body part 160, and is arranged on the uppermost end with being supported by the same. The socket part 120 is configured to move up and down by interaction of the elastic member 130, the first tapered member 140 and the second tapered member 150. Thereby, the socket part is coupled with the protrusion 110 formed on the lower surface of the upper swing structure 20 in a female/male engaging manner or is decoupled from the protrusion 110.

To this end, the socket part 120 in accordance with the embodiment of the present invention may include a socket body 121 and a groove 123. Here, the socket body 121 forms an external appearance of the socket part 120. An upper side of an outer peripheral surface of the socket body 121 is configured as an inclined surface 122 so as to make sliding contact with the inclined surface 111 of the protrusion 110. In this case, the inclined surface 122 of the socket body 121 preferably has the same inclination angle as the inclined surface 111 of the protrusion 110.

The groove 123 is formed inwardly from an upper end of the socket body 121 so that the protrusion 110 can be inserted therein.

When the protrusion 110 is moved by rotation of the upper swing structure 20 in a state where the socket part 120 has been moved up, the protrusion 110 and the socket part 120 encounter each other on a moving path of the protrusion 110, so that a side part of the protrusion 110 and a side part of the socket part 120 collide with each other. At this time, since the inclined surface 111 of the protrusion 110 and the inclined surface 122 of the socket part 120 have the same inclination angle and the socket part 120 is elastically supported in the gravity direction by the elastic member 130, the inclined surface 111 of the protrusion 110 and the inclined surface 122 of the socket part 120 are slid in opposite directions by a force applied from the protrusion 110, so that the protrusion 110 continues to move in the moving direction and the socket part 120 is moved down. When the protrusion 110 reaches the groove 123 while it continues to move, the contact between the protrusion 110 and the socket part 120 is released. Therefore, the socket part 120 is again moved up by an elastic restoring force of the elastic member 130, so that the protrusion 110 is located in the groove 123 and is thus restrained from further moving. When the protrusion 110 is restrained from moving by the socket part 120, the rotation of the upper swing structure 20 is also restrained.

The elastic member 130 is arranged on a lower side of the socket part 120. Also, the elastic member 130 is arranged on an upper side of the first tapered member 140. The elastic member 130 is configured to elastically support the socket part 120. The socket part 120 is coupled with the protrusion 110 by contraction and extension, which is generated by the elastic restoring force, of the elastic member 130. The contraction of the elastic member 130 is caused by a force that is applied from the protrusion 110 colliding with the socket part 120.

In the embodiment of the present invention, the elastic member 130 may be configured by a spring. However, the elastic member 130 is not limited to the spring. For example, the elastic member 130 may be configured by diverse materials and structures having elasticity, other than the spring.

The first tapered member 140 is arranged on a lower side of the elastic member 130 and is configured to support the elastic member 130. The first tapered member 140 is arranged on an upper side of the second tapered member 150. Also, the first tapered member 140 is arranged in the body part 160 with being restrained from moving in the horizontal direction. An upper surface of the first tapered member 140 is configured as a horizontal surface and a lower surface thereof is configured as an inclined surface 141. The inclined surface 141 of the first tapered member 140 is configured to make sliding contact with an inclined surface 151 of the second tapered member 150 having the same inclination angle. The first tapered member 140 is configured to move up and down as the second tapered member 150 is moved in the horizontal direction, so that the socket part 120 is also moved up and down. This configuration will be described later in more detail.

The second tapered member 150 is arranged on a lower side of the first tapered member 140. An upper surface of the second tapered member 150 is configured as an inclined surface 151 having the same inclination angle as the inclined surface 141 of the first tapered member 140 so as to make sliding contact with the inclined surface 141 of the first tapered member 140, and a lower surface thereof is configured as a horizontal surface. Also, the second tapered member 150 is coupled with the body part 160 so that it can be moved in the horizontal direction.

The second tapered member 150 is configured to move up and down the first tapered member 140 through horizontal movement toward a right side and a left side (based on the drawings), thereby moving up the socket part 120 to a position at which the socket part can be coupled with the protrusion 110 formed on the lower surface of the upper swing structure 20 or moving down the socket part 120 so that the socket part is to be decoupled from the protrusion 110.

In the embodiment of the present invention, the socket part 120 is configured to be coupled with or decoupled from the protrusion 110 formed on the lower surface of the upper swing structure 20 through a change in height resulting from the interaction between the first tapered member 140 and the second tapered member 150 and a change in height resulting from the elastic action of the elastic member 130.

The body part 160 is a case configured to provide an installation space of the socket part 120, the elastic member 130, the first tapered member 140 and the second tapered member 150 and to support the same. To this end, the body part 160 is formed on an upper surface of the lower traveling structure 10.

In the embodiment of the present invention, the body part 160 is configured to accommodate therein the socket part 120, the elastic member 130 and the first tapered member 140. Also, an upper end of the body part 160 is opened so as to enable the socket part 120 to move up and down. Here, since the socket part 120 is supported by the elastic member 130, the socket part is likely to shake leftward and rightward. In this case, the socket part 120 and the protrusion 110 are not aligned in a vertical direction and cannot be thus coupled with each other. In order to prevent this situation, the socket part 120 is accommodated in the body part 160 so that the horizontal movement of the socket part can be restrained even in a state where the socket part is moved to the highest position. In this case, the first tapered member 140 accommodated in the body part 160 is also restrained from moving in the horizontal direction.

In the meantime, the body part 160 has a lower end of which both sides in the horizontal direction are opened so that the second tapered member 150 can be inserted therein. In this case, a maximum degree of insertion of the second tapered member 150 (the second tapered member is structurally inserted from the left toward the right, based on the drawings) is limited by a size of the left opening of the body part 160. Thus, both longitudinal sides of the second tapered member 150 inserted in the body part 160 protrude outward from the body part 160 all the time. Therefore, even when the second tapered member 150 is moved leftward and rightward, only a degree of protrusion of both longitudinal sides of the second tapered member 150 is changed.

Like this, when the maximum degree of insertion of the second tapered member 150 is limited by the body part 160, the maximum height to which the socket part 1:20 can move up is also limited, so that the socket part 120 is moved up to only an appropriate position for coupling with the protrusion 110. Therefore, when coupling the protrusion 110 and the socket part 120, a driver or an operator has only to push rightward the second tapered member 150, so that a setting operation for coupling the protrusion 110 and the socket part 120 is completed.

In the below, operations of the apparatus for fixing an upper swing structure of a construction machine in accordance with the embodiment of the present invention are described.

1. Lock Mode

As shown in FIG. 1, when the driver moves rightward the second tapered member 150, the first tapered member 140 is moved up along the inclined surface 151 of the second tapered member 150. Thereby, the elastic member 130 and the socket part 120 are also moved up. At this time, the socket part 120 is moved up to a coupling position with the protrusion 110, i.e., a position at which the socket part can make side contact with the protrusion 110.

Figure 3:
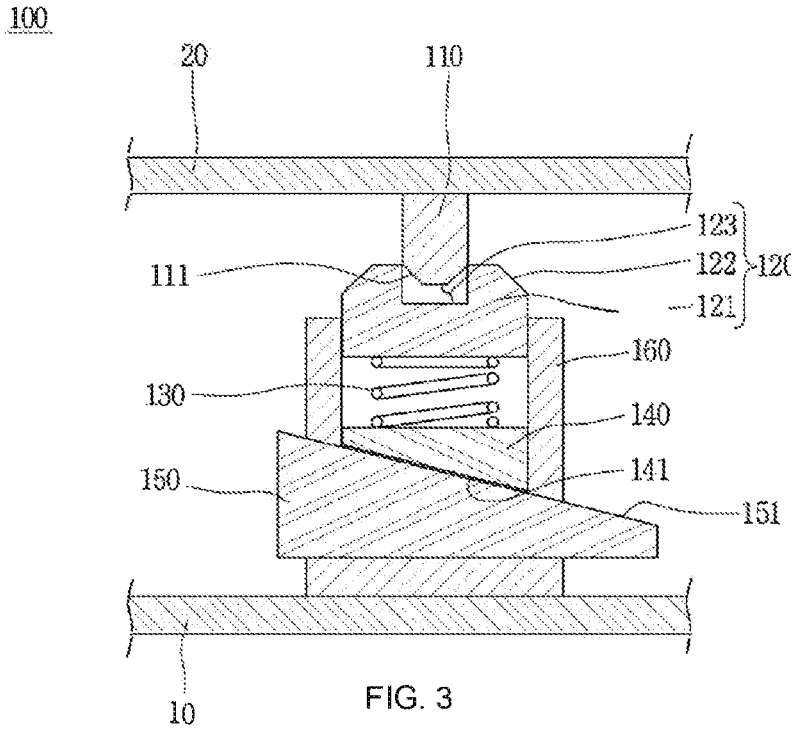
FIG. 3 is a schematic sectional view depicting a lock mode of the apparatus for fixing an upper swing structure in accordance with the embodiment of the present invention.

In this state, when the driver rotates the upper swing structure 20, the protrusion 110 encounters the socket part 120 with moving, so that side parts of the protrusion 110 and the socket part 120 collide with each other. At this time, the collision parts of the protrusion 110 and the socket part 120 are the inclined surfaces 111, 122 thereof, and the inclined surfaces 111, 122 come in sliding contact with each other. In this state, the protrusion 110 intends to keep moving as the upper swing structure 20 is rotated. Therefore, a force applied from the protrusion 110 in this state is transmitted to the elastic member 130, so that the elastic member 130 is contracted and the socket part 120 is thus moved down. In this state, when the protrusion 110 reaches the groove 123 while it continues to move, the contact between the protrusion 110 and the socket part 120 is released, so that the socket part 120 is again moved up by the elastic restoring force of the elastic member 130. Thereby, as shown in FIG. 3, the protrusion 110 is located in the groove 123 and is thus restrained from further moving. When the protrusion 110 is restrained from moving by the socket part 120, i.e., when the apparatus 100 for fixing an upper swing structure is switched to the lock mode, the upper swing structure 20 is switched to the rotation preventing mode, so that it is possible to operate the wheel-type excavator in a traveling mode.

2. Lock Releasing Mode

Figure 4:
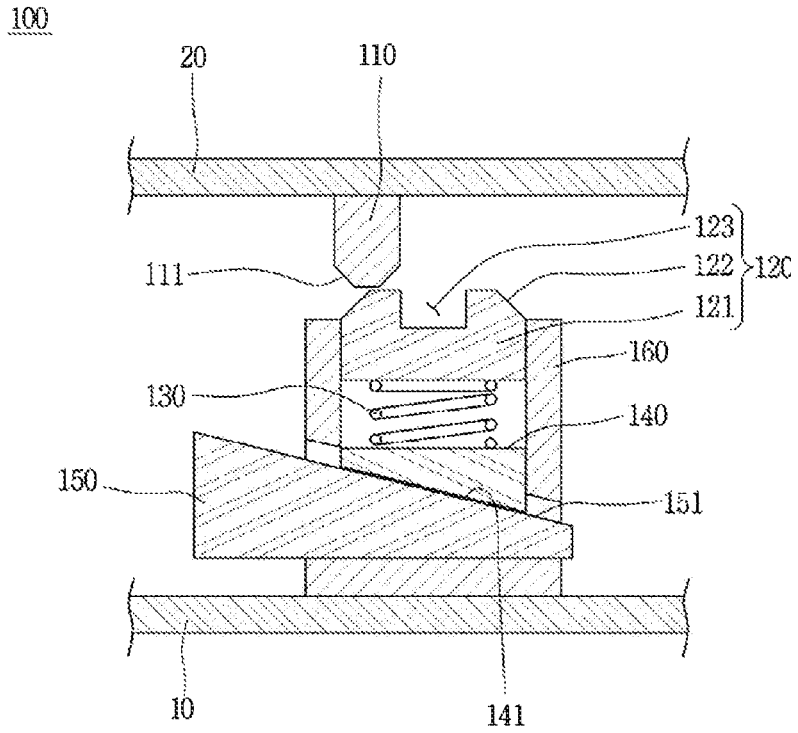
FIG. 4 is a schematic sectional view depicting a lock releasing mode of the apparatus for fixing an upper swing structure in accordance with the embodiment of the present invention.

As shown in FIG. 4, when the driver moves leftward the second tapered member 150, the first tapered member 140 is moved down along the inclined surface 151 of the second tapered member 150. Thereby, the elastic member 130 and the socket part 120 are also moved down. At this time, the socket part 120 is moved down up to a position at which the socket part is not to collide with the protrusion 110 when the protrusion 110 moves in the horizontal direction. As a result, the protrusion 110 is decoupled from the socket part 120. When the protrusion 110 is decoupled from the socket part 120 in this way, i.e., when the apparatus 100 for fixing an upper swing structure is switched to the lock releasing mode, the upper swing structure 20 is switched to the rotation mode in which the upper swing structure can be freely rotated. Therefore, it is possible to operate the wheel-type excavator in a working mode.

In this way, before the traveling of the wheel-type excavator, the driver can conveniently fix the upper swing structure 20 on the lower traveling structure 10 by the apparatus 100 for fixing an upper swing structure. Also, the driver can conveniently switch the upper swing structure 20 fixed on the lower traveling structure 10 to the rotatable condition before the work of the wheel-type excavator. That is, the driver can conveniently change the upper swing structure 20 to the rotation preventing mode or the rotation mode in accordance with the operating method of the wheel-type excavator.

Although the present invention has been described with reference to the specific embodiments and the drawings, the present invention is not limited to the embodiments, and a variety of variations and modifications can be made by one skilled in the art of the present invention.

Therefore, the scope of the present invention should not be defined by the above-described embodiments but should be defined by the appended claims and equivalents thereof.

The invention claimed is:

1. An apparatus for fixing an upper structure of a construction machine on a lower structure of the construction machine, the upper structure being horizontally rotatable on the lower structure, the apparatus comprising:

a protrusion formed on a lower surface of the upper structure and having a lower side of an outer peripheral surface configured as an inclined surface;

a socket part formed on an upper side of the lower structure and configured to be releasably coupled with the protrusion in a female/male engaging manner;

an elastic member arranged on a lower side of the socket part and elastically supporting the socket part;

a first tapered member arranged on a lower side of the elastic member, supporting the elastic member, and having a lower surface configured as an inclined surface;

a second tapered member arranged on a lower side of the first tapered member, having an upper surface configured as an inclined surface so as to make sliding contact with the inclined surface of the first tapered member, and configured to move up the socket part to a position at which the socket part is coupled with the protrusion to prevent the upper structure from rotating with respect to the lower structure by moving up the first tapered member and the elastic member or to move down the socket part to another position at which the socket part is decoupled from the protrusion to allow the upper structure to rotate with respect to the lower structure by moving down the first tapered member and the elastic member, through horizontal movement via a relative slide movement between the inclined surface of the first tapered member and the inclined surface of the second tapered member; and a body part supporting the socket part, the elastic member, the first tapered member and the second tapered member to keep the socket part arranged above the elastic member, the elastic member arranged above the first tapered member, and the first tapered member arranged above the second tapered member.

2. The apparatus according to claim 1, wherein the inclined surface of the first tapered member and the inclined surface of the second tapered member have the same inclination angle, and an upper surface of the first tapered member and a lower surface of the second tapered member are horizontal surfaces.

3. The apparatus according to claim 1, wherein the body part is formed on an upper surface of the lower structure, is configured to accommodate therein the socket part, the elastic member and the first tapered member, and has an upper end opened so as to enable the socket part to move up and down and a lower end of which both sides in a horizontal direction are opened so that the second tapered member is allowed to be inserted therein.

4. The apparatus according to claim 3, wherein the first tapered member is restrained from moving in the horizontal direction by the body part.

5. The apparatus according to claim 4, wherein when the second tapered member moves toward one side in the horizontal direction, the first tapered member moves up along the inclined surface of the second tapered member, and when the second tapered member moves toward the other side in the horizontal direction, the first tapered member moves down along the inclined surface of the second tapered member.

6. The apparatus according to claim 1, wherein the socket part comprises:

a socket body having an upper side of an outer peripheral surface configured as an inclined surface so as to make sliding contact with the inclined surface of the protrusion, and a groove formed inwardly from an upper end of the socket body so that the protrusion can be inserted therein.

7. The apparatus according to claim 6, wherein the inclined surface of the protrusion and the inclined surface of the socket body have the same inclination angle.

* * * * *